US010655248B2

(12) United States Patent
Youn et al.

(10) Patent No.: US 10,655,248 B2
(45) Date of Patent: May 19, 2020

(54) METHOD OF PREPARING POLYESTER FABRIC FOR AIRBAG

(71) Applicant: KOLON INDUSTRIES, INC., Gwacheon-si, Gyeonggi-do (KR)

(72) Inventors: Jung-Hoon Youn, Yongin-si (KR); Hye-Seung Jin, Yongin-si (KR); Dong-Jin Kwak, Yongin-si (KR); Jae-Hyung Kim, Yongin-si (KR)

(73) Assignee: KOLON INDUSTRIES, INC., Seoul (KR)

( * ) Notice: Subject to any disclaimer, the term of this patent is extended or adjusted under 35 U.S.C. 154(b) by 602 days.

(21) Appl. No.: 15/321,923

(22) PCT Filed: Jun. 24, 2015

(86) PCT No.: PCT/KR2015/006437
§ 371 (c)(1),
(2) Date: Dec. 23, 2016

(87) PCT Pub. No.: WO2015/199444
PCT Pub. Date: Dec. 30, 2015

(65) Prior Publication Data

US 2017/0137976 A1 May 18, 2017

(30) Foreign Application Priority Data

Jun. 24, 2014 (KR) ..... 10-2014-0077494

(51) Int. Cl.
*D03D 1/02* (2006.01)
*D03D 13/00* (2006.01)
(Continued)

(52) U.S. Cl.
CPC ..... *D03D 1/02* (2013.01); *D01F 6/62* (2013.01); *D03D 5/00* (2013.01); *D03D 13/004* (2013.01);
(Continued)

(58) Field of Classification Search
CPC ..... D03D 1/02; D03D 15/00; D03D 11/02; D03D 13/008; D03D 15/0083;
(Continued)

(56) References Cited

U.S. PATENT DOCUMENTS 5,236,775 A 8/1993 Swoboda et al.
5,421,378 A * 6/1995 Bowers ..... B60R 21/235 139/100
(Continued)

FOREIGN PATENT DOCUMENTS

CN 102713031 A 10/2012
CN 102899773 A 1/2013
(Continued)

OTHER PUBLICATIONS

European Patent Office; Communication dated Jan. 22, 2018 in counterpart European application No. 15811478.5.
(Continued)

*Primary Examiner* — Robert H Muromoto, Jr.
(74) *Attorney, Agent, or Firm* — Sughrue Mion, PLLC

(57) ABSTRACT

A method of preparing a polyester fabric for an airbag is provided, and particularly, a method of preparing a fabric for an airbag by inserting a predetermined weave into a selvage to provide the whole fabric with uniform tension upon weaving a high-density fabric for an airbag using a polyester yarn is provided.

9 Claims, 1 Drawing Sheet

(a)

(b)

(51) Int. Cl.

| | |
|---|---|
| ***D03D 15/00*** | (2006.01) |
| ***D01F 6/62*** | (2006.01) |
| ***D03D 5/00*** | (2006.01) |
| ***D06N 3/00*** | (2006.01) |
| ***D06N 3/12*** | (2006.01) |

(52) U.S. Cl.
CPC ..... *D03D 15/00* (2013.01); *D06N 3/0006* (2013.01); *D06N 3/128* (2013.01); *D06N 2201/02* (2013.01); *D06N 2203/066* (2013.01); *D06N 2209/125* (2013.01); *D10B 2331/04* (2013.01); *D10B 2505/124* (2013.01)

(58) Field of Classification Search
CPC .... D03D 15/0088; D03D 47/32; D03D 47/40; D03D 49/04; D03D 5/00
See application file for complete search history.

(56) References Cited

U.S. PATENT DOCUMENTS

| | | | | |
|---|---|---|---|---|
| 6,135,161 | A | 10/2000 | Nakano et al. | |
| 6,182,709 | B1 | 2/2001 | Konishi et al. | |
| 8,286,747 | B2 | 10/2012 | Kim | |
| 10,246,800 | B2 * | 4/2019 | Jin | D03D 1/02 |
| 2001/0005660 | A1 * | 6/2001 | Li | B32B 27/12 442/71 |
| 2002/0036023 | A1 * | 3/2002 | Sollars | D03D 47/40 139/109 |
| 2002/0140218 | A1 | 10/2002 | Beasley, Jr. | |
| 2007/0031621 | A1 | 2/2007 | Morimoto et al. | |
| 2007/0184733 | A1 * | 8/2007 | Manley | B60R 21/235 442/59 |
| 2008/0231025 | A1 * | 9/2008 | Youn | D03D 1/02 280/728.1 |
| 2010/0253047 | A1 | 10/2010 | Youn et al. | |
| 2010/0260976 | A1 | 10/2010 | Kano et al. | |
| 2011/0165806 | A1 * | 7/2011 | Kim | D03D 1/02 442/60 |
| 2012/0043745 | A1 | 2/2012 | Bae et al. | |
| 2012/0263401 | A1 | 10/2012 | Jung et al. | |
| 2013/0273276 | A1 | 10/2013 | Han et al. | |
| 2014/0021705 | A1 | 1/2014 | Youn et al. | |
| 2015/0218735 | A1 | 8/2015 | Kim et al. | |
| 2015/0239419 | A1 * | 8/2015 | Jin | D06N 3/128 442/169 |
| 2015/0246655 | A1 * | 9/2015 | Furuniwa | D03D 1/02 139/420 R |

FOREIGN PATENT DOCUMENTS

| | | | |
|---|---|---|---|
| EP | 1 669 481 | A1 | 6/2006 |
| JP | 04-214437 | A | 8/1992 |
| JP | 5-51836 | A | 3/1993 |
| JP | 9-302549 | A | 11/1997 |
| JP | 2002-321585 | A | 11/2002 |
| JP | 2005-179806 | A | 7/2005 |
| JP | 2014-514470 | A | 6/2014 |
| KR | 10-2000-0005141 | A | 1/2000 |
| KR | 2003-0078629 | A | 10/2003 |
| KR | 10-0541510 | B1 | 12/2005 |
| KR | 10-0680564 | B1 | 2/2007 |
| KR | 10-2010-0105577 | A | 9/2010 |
| KR | 10-2010-0117527 | A | 11/2010 |
| KR | 10-1011236 | B1 | 1/2011 |
| KR | 10-2012-0058024 | A | 6/2012 |
| KR | 10-2013-0007267 | A | 1/2013 |
| KR | 10-2014-0043004 | A | 4/2014 |
| WO | 97/037874 | A1 | 10/1997 |

OTHER PUBLICATIONS

The State Intellectual Property Office of People's Republic of China; Communication dated Sep. 20, 2017 in counterpart CN application No. 201580034770.0.
The Japanese Patent Office; Communication dated Nov. 14, 2017 in counterpart JP application No. 2016-573787.
International Searching Authority, International Search Report for PCT/KR2015/006437 dated Aug. 13, 2015 [PCT/ISA/210].
International Searching Authority, Written Opinion for PCT/KR2015/006437 dated Aug. 13, 2015 [PCT/ISA/237].

* cited by examiner

[FIG. 1]
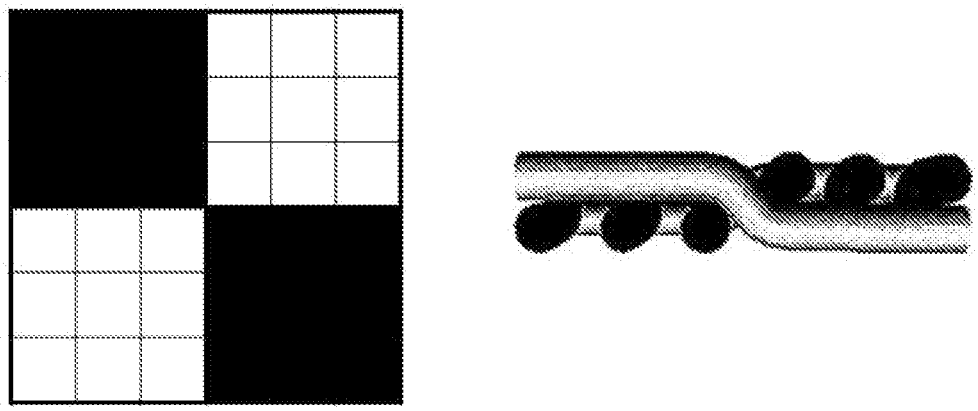
(a) (b)
[FIG. 2]
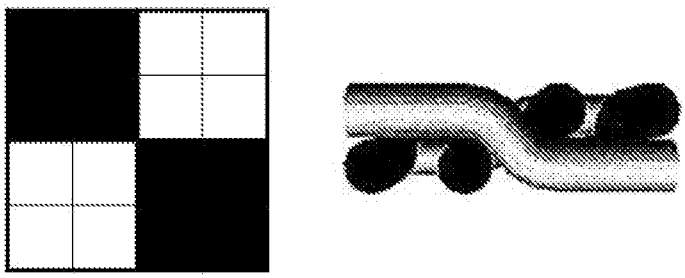
(a) (b)
[FIG. 3]
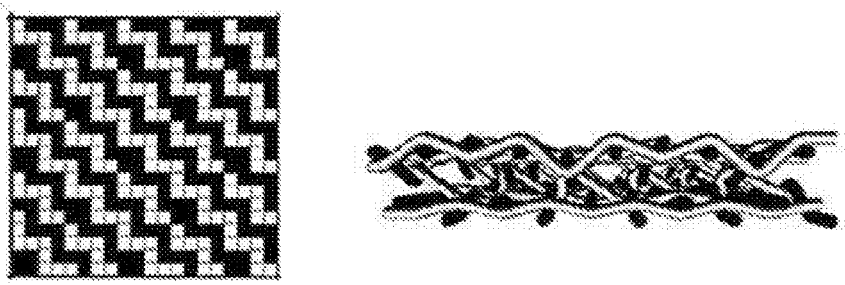
(a) (b)

METHOD OF PREPARING POLYESTER FABRIC FOR AIRBAG

CROSS REFERENCE TO RELATED APPLICATIONS

This application is a 371 National Stage Application of International Application No. PCT/KR2015/006437 filed Jun. 24, 2015, claiming priority based on Korean Patent Application No. 10-2014-0077494 filed Jun. 24, 2014, the contents of all of which are incorporated herein by reference in their entirety.

TECHNICAL FIELD

The present disclosure relates to a method of preparing a polyester fabric for an airbag. More particularly, the present disclosure relates to a method of preparing a fabric for an airbag, which enables the whole fabric to be provided with uniform tension upon weaving a high-density fabric for an airbag using a polyester yarn.

BACKGROUND ART

Generally, an airbag is an apparatus for protecting a driver and passengers during a head-on collision of a vehicle driving at a speed of about 40 km/h or more, by sensing collision impact of the vehicle with an impact sensor, and then exploding gunpowder to supply a gas into the airbag, thereby inflating it.

Characteristics required of the fabric for an airbag are low air permeability for unfolding the airbag well at the time of collision, high strength and high heat resistance for preventing damage to and rupture of the airbag itself, and flexibility for reducing the impact provided to occupants.

Particularly, the airbag for a vehicle is prepared in a certain shape and installed in a steering wheel, side windows, or side structures of the vehicle in a folded form to minimize its volume, and it is expanded and unfolded when an inflator operates.

To ensure superior expanding and unfolding performances upon unfolding of the airbag by abrupt gas generation in the inflator, air-tightness of the airbag cushion may be increased by maintaining the correct shape in the warp or weft direction. However, a polyamide fiber such as nylon 66 which has been previously used in the preparation of an airbag cushion is generally sensitive to temperature and speed, and thus it is difficult to maintain the correct shape in the warp or weft direction upon cutting a fabric. Particularly, in the case of a large-sized cushion, fabric cutting is not performed accurately, which generates problems of poor appearance and reduced productivity.

Meanwhile, Japanese Patent Publication No. Heisei 04-214437 suggested use of a polyester fiber in a fabric for an airbag in order to reduce the drawbacks of the polyamide fiber. However, when the airbag is manufactured by using the prior polyester fiber, it is difficult to install the airbag in a narrow space in a vehicle because of its high stiffness, excessive thermal shrinkage is caused by heat-treatment at a high temperature due to its high modulus and low elongation, and there is a limitation in maintaining sufficient mechanical and unfolding properties under severe conditions of high temperature and high humidity.

Further, when a polyester yarn is applied to weave a high-density fabric for an airbag, a force applied to a weft insertion region is not the same as a force applied to a region opposite to the weft insertion region, and therefore a force applied to a yarn in the weft insertion region becomes higher than a force applied to a yarn in the region opposite to the weft insertion region, such that a fabric in the region opposite to the weft insertion region is not woven firmly, resulting in wrinkle generation in a selvage of the fabric.

Due to this problem, a coating agent is not evenly applied onto the whole fabric upon processing and coating, and thermal stress remaining in the fabric used in a vehicle airbag is released, and as a result, shrinkage of the fabric occurs. Further, this shrinkage deformation characteristic may cause a change in the intrinsic weaving density of the fabric to generate problems such as reductions in air permeability performance and dimensional stability, changes in the volume and thickness of a final cushion product, etc.

Accordingly, there is a need to develop a process capable of effectively preparing a polyester fabric for an airbag, which enables the whole fabric to be provided with uniform tension upon weaving a high-density fabric for an airbag using a polyester yarn, and is able to effectively prepare a polyester fabric for an airbag having superior mechanical properties and air-tightening effect to be suitable as a fabric for a vehicle airbag.

DISCLOSURE

Technical Problem

The present invention provides a method of preparing a fabric for an airbag having superior mechanical properties and superior packing property, dimensional stability, and air-tightening effect at the same time by providing the whole fabric with uniform tension upon weaving a high-density fabric for an airbag using a polyester fiber.

Further, the present invention provides a fabric for an airbag prepared by the above method.

Technical Solutions

A method of preparing a polyester fabric for an airbag is provided, the method including weaving a raw fabric for an airbag using a polyester fiber, in which a high-density weave of 20 yarns to 100 yarns is inserted into a selvage of the raw fabric for an airbag in the weaving process.

Hereinafter, a method of preparing a polyester fabric for an airbag according to specific embodiments of the present invention will be described in more detail. However, the following is for illustrative purposes only and the scope of the present invention is not intended to be limited thereby, and it is obvious to a person skilled in the related art that the embodiments may be modified in many different forms within the scope of the present invention.

In addition, "include" or "contain" means to include any components (or ingredients) without particular limitation unless there is a particular mention about them in this description, and it may not be interpreted with a meaning of excluding an addition of other components (or ingredients).

Meanwhile, the fabric for an airbag, as used herein, refers to a woven fabric or a nonwoven fabric that is used for manufacturing an airbag for a vehicle. A nylon 66 plain fabric woven by a rapier loom or a nylon 66 nonwoven fabric has been used as a general fabric for an airbag. However, the fabric for an airbag of the present invention is characterized by having superior basic physical properties such as dimensional stability, toughness, air permeability, stiffness, etc. by using a polyester fiber.

In order to apply the polyester fiber to the fiber for an airbag instead of the prior polyamide fiber such as nylon 66, deterioration in performances such as long-term stability of physical properties, packing property, cushion unfoldability, etc. should be overcome by improving heat resistance and modulus of the prior polyester fiber.

Polyester has a stiffer structure than that of nylons in terms of molecular structure, and has a characteristic of a high modulus. Therefore, when a polyester yarn is applied to weave a high-density fabric for an airbag, a force applied to a weft insertion region (a starting point of weft weaving) is not the same as a force applied to a region opposite to the weft insertion region (an end point of weft weaving), and therefore it is difficult to maintain uniform physical properties of the whole fabric in a subsequent coating process, etc. Particularly, since the polyester yarn has lower elasticity than nylon, there is a problem that sagging of a fabric at a lower tension after weaving occurs.

Accordingly, the present inventors confirmed that when a predetermined high-density, high-tension weave is inserted into a selvage upon weaving a high-density fabric for an airbag using a polyester fiber to provide the whole fabric with uniform tension, the fabric for an airbag has improved physical properties, thereby completing the present invention.

According to an embodiment of the present invention, a method of preparing a fabric for an airbag having superior mechanical properties and dimensional stability by using a polyester fiber is provided. The method of preparing the polyester fabric for an airbag includes weaving a raw fabric for an airbag using the polyester fiber, in which a high-density weave of 20 yarns to 100 yarns may be inserted into a selvage of the raw fabric for an airbag in the weaving process.

The fabric for an airbag of the present invention is characterized in that a high-density weave having higher tension than other parts of the fabric is separately inserted into a selvage which is not included in a final product but is removed by cutting in a cutting process, upon weaving the high-density fabric for an airbag using the polyester fiber, thereby artificially providing the whole fabric with uniform tension. In particular, upon weaving the high-density fabric for an airbag using the polyester yarn having lower elasticity than nylon, a high-density, high-tension weave is inserted into the selvage corresponding to an end point of weft weaving at which a tension becomes low, thereby remarkably reducing sagging of the fabric.

The high-density weave may be composed of 20 yarns to 100 yarns, preferably 30 yarns to 95 yarns, and more preferably 40 yarns to 90 yarns. In this regard, the high-density weave must be composed of 20 yarns or more in terms of controlling the tension uniformly in the width direction of the fabric, and the high-density weave must be composed of 100 yarns or less in terms of preventing weaving machine errors and avoiding a reduction of productivity. However, in the case of an OPW (one piece woven) type of fabric, the tension of the selvage greatly differs according to a shape to be designed, and therefore the high-density, high-tension weave inserted into the selvage may be selected and the number of yarns to be applied may be determined depending on the cushion design.

Further, the high-density weave may be a 3×3 basket weave (FIG. 1), a 2×2 basket weave (FIG. 2), a partially co-woven weave (FIG. 3), or a mixed weave of one or more thereof, as shown in FIGS. 1 to 3. As shown in FIG. 3, the circumference of two separated fabric layers is partially co-woven into a single fabric so that a plain double-layered weave of a partially co-woven type may be included. However, the 2×2 basket weave or the 3×3 basket weave is preferred in terms of preventing tension fluctuation in the warp direction and easily controlling tension in the width direction.

In the present invention, the polyester fabric for an airbag may be prepared by weaving the fabric using the polyester fiber as a weft and a warp. In this regard, the polyester fiber may have total fineness of 200 denier to 1000 denier, preferably 300 denier to 950 denier, and more preferably 400 denier to 900 denier. The polyester fiber may have total fineness of 200 denier or more in terms of strength of the fabric, and total fineness of 1000 or less in terms of packing property of the cushion. The denier is a unit indicating the fineness of a yarn or a fiber, and 9000 m of yarn weighing 1 g is 1 denier. Further, it is preferable that the number of filaments of the polyester fiber may be 50 to 210, and preferably 60 to 180, because a high number of filaments of the polyester fiber may give a softer feel, but too high a number of filaments may not be good in terms of spinnability.

Particularly, in the present invention, a polyester fiber having an initial modulus of 45 g/d to 100 g/d, preferably 50 g/d to 90 g/d, and more preferably 55 g/d to 85 g/d, which is lower than that of the previously known polyester fiber (commonly, an initial modulus of 120 g/de or more), may be used in the preparation. In this regard, the modulus of the polyester fiber means a modulus value of elasticity that is obtained from a gradient in an elastic range of a strength-strain graph obtained by a tensile test. When the modulus of the fiber is high, the elasticity is good but the stiffness of the fabric may become bad. On the other hand, when the modulus is too low, the stiffness of the fabric is good but the elastic recovery becomes low and the toughness of the fabric may become bad. As such, since the fabric for an airbag is prepared from the polyester fiber having a lower initial modulus than that of the prior fiber, the fabric may resolve the problem caused by the high stiffness of the prior PET fabric, and may show superior foldability, flexibility, and packing properties.

Furthermore, the polyester fiber is preferably a poly (ethylene terephthalate) (PET) fiber among common polyesters, and more preferably, a PET fiber including PET in an amount of 70 mol % or more, preferably 90 mol % or more.

The polyester fiber may show a tensile strength of 8.0 g/d or more, preferably 8.0 to 10.0 g/d, and more preferably 8.3 g/d to 9.5 g/d, and elongation at break of 15% to 27%, and preferably 18% to 24%. The dry heat shrinkage of the polyester fiber may be 1.0% to 5.0%, and preferably 1.2% to 3.5%. As disclosed above, the polyester fabric of the present invention may exhibit superior performance when it is prepared as the fabric for an airbag by using the polyester fiber having intrinsic viscosity, an initial modulus, and elongation in the optimized ranges.

Meanwhile, the process of weaving the raw fabric for an airbag using the polyester fiber may be performed by using a common weaving machine, and the weaving machine is not limited to any particular weaving machine. For example, the plain-type fabrics may be prepared by using a Rapier Loom, an Air Jet Loom, a Water Jet Loom, etc., and the OPW-type fabrics may be prepared by a Jacquard Loom such as a Jacquard Air Jet Loom, a Jacquard Water Jet Loom, etc. However, the polyester fabric for an airbag of the present invention may be woven in the OPW (one piece woven) type by the Jacquard Loom in terms of improving performance of maintaining an internal pressure upon preparing the airbag cushion, simplifying the entire preparation process, and effectively reducing the cost of the process. In particular, when two separated fabric layers are co-woven in the OPW (one piece woven) type, a subsequent coating process is performed on both sides of the double-layered fabric at the same time, and therefore it is very important to provide the whole fabric with uniform tension by inserting the high-density weave into the selvage of the fabric as described above.

A weaving tension of the polyester fabric for an airbag may be 200 to 400 N, preferably 200 to 300 N, and the weaving tension is preferably 200 N or more in terms of weaving property and 400 N or less in terms of avoiding generation of yarn breakage according to reductions of a spinning oil and a weaving oil.

Further, a weaving speed of the polyester fabric for an airbag may be 400 to 700 RPM, preferably 450 to 650 RPM, and the weaving speed is preferably 450 RPM or more in terms of enhancing productivity and 650 RPM or less in terms of removal of the spinning oil and the weaving oil and avoiding generation of defects.

In this regard, each of the warp density and weft density of the polyester fabric for an airbag, that is, each of the warpwise weaving density and weftwise weaving density of the polyester fabric may be 36 to 65 yarns/inch, preferably 38 to 63 yarns/inch, and more preferably 40 to 60 yarns/inch, respectively. Each of the warp density and weft density of the polyester fabric for an airbag may be 36 yarns/inch or more in terms of ensuring superior mechanical properties of the fabric for an airbag, and may be 65 yarns/inch or less in terms of improving air-tightness and foldability of the fabric.

Furthermore, it is very important to minimize the elongation of the polyester fabric against a tensile force caused by high-pressure air in order to improve the air-tightness of the polyester fabric for an airbag, and to maximize the energy-absorbing performance of the polyester fabric from high-temperature and high-pressure exhaust gas in order to secure sufficient mechanical properties at the time of operating the airbag. Therefore, the fabric for an airbag of the present invention may be a high-density fabric having a cover factor of 1500 or more. Particularly, the fabric is woven and processed so that it has the cover factor of 1500 to 2500 according to the following Equation 1, thereby improving the air-tightness and energy-absorbing performance at the time of airbag unfolding.

$$\text{Cover Factor (CF)} = \text{warp density} \times \sqrt{\text{warpdenier}} + \text{weft density} \times \sqrt{\text{weftdenier}} \quad \text{[Equation 1]}$$

Herein, when the cover factor of the fabric is less than 1500, there is a problem in that air is easily discharged to the outside during air expansion, and when the cover factor of the fabric thereof is more than 2500, there is a problem in that the packing property and foldability of the airbag cushion may be remarkably deteriorated when an airbag is mounted. However, the cover factor of the high-density fabric for an airbag according to the present invention may be 1600 or more, 1700 or more, or 1780 or more according to the weaving method of the fabric or the kind of yarn.

In the present invention, the fabric after the weaving process may be further subjected to scouring and tentering processes.

The scouring process may be performed under a temperature condition of 40° C. to 100° C., preferably 45° C. to 99° C., and more preferably 50° C. to 98° C. Contaminants and foreign substances generated in yarn production or fabric weaving may be removed from the fabric woven via the scouring process. A residence time in the scouring process may be controlled according to a process speed to move the fabric from a scouring bath, and the scouring speed of the fabric may be 5 m/min to 30 m/min, preferably 10 m/min to 30 m/min, and more preferably 10 m/min to 20 m/min. Such scouring process conditions may be modified according to process efficiency, and as necessary, considering the suitability of, for example, a scouring agent, etc. Further, after the scouring process, the fabric may be subjected to a tentering process which is a thermal fixing step to fix a shape, so that the shape is not changed by external influences.

The fabric thus scoured may be subjected to a tentering process to ensure superior dimensional stability of the polyester fabric for an airbag. The tentering process may be performed under an overfeed condition of 5% to 10%, preferably 5.5% to 9.5%, and more preferably 6% to 9%. In this regard, the overfeed refers to a supply when the scoured fabric is fed into a chamber in the tentering process, and it represents a difference (%) between a feed rate and a discharge rate of the fabric in the tentering process. For example, the overfeed of the tentering process may be calculated as a percentage (%) of an operating speed of a feeding roller and an operating speed of a winding roller. When the fabric is fed into the chamber with an overfeed of more than 10%, pin missing due to hot air in the chamber may occur, uniform heat-treatment may not be accomplished, and an excessive weft density may be provided. In contrast, when the overfeed of the tentering process is less than 5%, there are problems of fabric damage and lowered weft density due to excessive tension. In this case, the weft density becomes low, air permeability of the fabric becomes high, and the cushion may not be prepared in a desired size.

In the tentering process, the feed rate of the scoured fabric, that is, the operating speed of the feeding roller, may be 10 m/min to 40 m/min, and more preferably 15 m/min to 35 m/min. The feed rate of the fabric is closely related to the residence time of the fabric in the chamber in the scouring process. In particular, if the feed rate is less than 10 m/min, excess residence in the heat chamber may cause a reduction in softness of the fabric and heat damage. In contrast, when the feed rate exceeds 40 m/min, and thus the tentering process is performed too fast, the residence time of the fabric in the chamber is too short, and therefore sufficient heat treatment of the fabric may not occur, resulting in uneven shrinkage of the fabric.

The tentering process is a process to control the density and the dimensions of the fabric by adjusting the density of the fabric shrunk in the scouring step to a certain level required of a product. In the present invention, the tentering step may be carried out under a temperature condition of 150° C. to 190° C., preferably 153° C. to 185° C., and more preferably 155° C. to 180° C. The tentering process temperature may be within the above-described range in terms of minimizing thermal shrinkage of the fabric and improving dimensional stability.

In the present invention, the method may further include coating the woven fabric or the fabric additionally subjected to scouring and tentering processes with a rubber component.

When the fabric for an airbag is generally woven using the polyester yarn, as the polyester yarn has low elasticity compared to nylon, sagging of a fabric at a lower tension after weaving occurs, and a coating weight deviation occurs because of the different tensions between a knife and the fabric. In the present invention, however, the predetermined weave is inserted into the selvage upon weaving the high-density fabric for an airbag using the polyester fiber to provide the whole fabric with uniform tension, and as a result, a coating agent is evenly applied to the whole fabric upon coating, and superior mechanical properties of the fabric for an airbag may be ensured.

In the present invention, the coating with the rubber component may be performed on one side or both sides of the fabric, and the rubber component may be one or more selected from the group consisting of a powder-type silicone, a liquid-type silicone, polyurethane, chloroprene, a neoprene rubber, polyvinyl chloride, and an emulsion-type silicone resin. The powder-type silicone, the liquid-type silicone, or a mixture thereof is preferred in terms of air-tightness and strength maintenance upon unfolding.

As described above, according to the present invention, the predetermined high-density weave is inserted into the selvage upon weaving the high-density fabric for an airbag to provide the whole fabric with uniform tension, thereby evenly applying the coating agent onto the whole fabric upon coating. Accordingly, a coating weight of the rubber component per unit area may be 15 g/m$^2$ to 150 g/m$^2$, preferably 20 g/m$^2$ to 140 g/m$^2$, and more preferably 30 g/m$^2$ to 130 g/m$^2$, and in order to obtain superior scrub resistance and internal pressure maintaining property, the coating weight may be 15 g/m$^2$ or more, and the coating weight may be 150 g/m$^2$ or less in terms of packing property.

Further, the coating weight deviation of the rubber component per unit area may be ±20%, that is, within 20%, preferably ±18%, and more preferably ±15%, in the width direction of the fabric.

The coating of the rubber component is for improving mechanical properties of the fabric for an airbag, effectively blocking air permeation to the surface of the fabric, and also for improving bonding performance and air-tightness through chemical bonding with the fabric. The coating of the rubber component is performed throughout the fabric surface. A common coating method, such as a knife coating method, a doctor blade method, a spray coating method, etc. may be performed as the coating method, and the knife coating method is preferably used.

For example, when a knife-over-air method is used, a coating weight may be controlled by sharpness of the knife and tension of the fabric. A coating process order includes equipping a knife after checking the thickness of the knife depending on the coating weight, and then mounting a plate for preventing a coating agent from flowing out into the other sides. Further, by proceeding with silicone discharge after setting the height and the angle depending on the coating weight, a base coating operation may be carried out. Particularly, in the present invention, the predetermined weave is inserted into the selvage upon weaving the polyester fabric for an airbag to provide the whole fabric with uniform tension, thereby preventing the fabric from sagging during the coating process and minimizing a tension deviation between the knife and the fabric to uniformly apply the coating agent onto the whole fabric. Meanwhile, in order to suppress a fabric sticking phenomenon generated due to the thickness and viscosity of the coating, a top coating operation may be carried out. Herein, the top coating may be performed in a manner using a gravure roll.

In order to dry the coating-finished fabric and cure the coating agent, a vulcanizing process may be further carried out. With the vulcanizing process lastly performed, the coating process is completed.

The vulcanizing process may be carried out at a temperature of 150° C. to 200° C., preferably 160° C. to 190° C., and most preferably 165° C. to 185° C. to proceed with curing. The vulcanizing temperature may be 150° C. or higher in terms of improving scrub resistance, and 200° C. or lower in terms of securing a preferred fabric thickness and stiffness. Further, curing time at the above vulcanizing temperature may be in the range of 120 seconds to 300 seconds, preferably 150 seconds to 250 seconds, and most preferably 180 seconds to 240 seconds. If the curing time is less than 120 seconds, the curing operation of the coating layer by a rubber component is not effectively performed, so that the mechanical properties of the fabric are reduced, and the coating may be stripped off. On the contrary, if the curing time is more than 300 seconds, the finally manufactured fabric has increased stiffness and thickness, thereby decreasing a folding property.

In the present invention, since matters other than the above description may be adjustable as necessary, they are not particularly limited in the present invention.

Effects of the Invention

According to the present invention, a method of preparing a fabric for an airbag having superior mechanical properties and superior packing property, dimensional stability, and air-tightening effect at the same time by inserting a predetermined high-density weave into a selvage upon weaving a high-density fabric for an airbag using a polyester fiber to provide the whole fabric with uniform tension is provided.

BRIEF DESCRIPTION OF DRAWINGS

FIG. 1 shows (a) a weave diagram of a 3×3 basket weave which is inserted into a selvage of a polyester fabric according to an embodiment of the present invention, and a cross-section thereof (b);

FIG. 2 shows (a) a weave diagram of a 2×2 basket weave which is inserted into a selvage of a polyester fabric according to an embodiment of the present invention, and a cross-section thereof (b); and FIG. 3 shows (a) a weave diagram of a plain double-layered weave of a partially co-woven type which is inserted into a selvage of a polyester fabric according to an embodiment of the present invention, and a cross-section thereof (b).

DETAILED DESCRIPTION OF THE EMBODIMENTS

Hereinafter, preferred examples are provided for better understanding of the present invention. However, the following examples are only illustrative of the present invention, and the scope of the present invention is not limited to the following examples.

EXAMPLES

Example 1

A polyester fabric for an airbag was prepared under conditions as shown in the following Table 1.

First, a raw fabric for an airbag having a cover factor of 2370 was woven using a multifilament polyester fiber (the number of filaments: 144) of 500 denier by a Jacquard air jet loom and by applying a warp density of 57 yarns/inch and a weft density of 49 yarns/inch as a weaving density. At this time, a 3×3 basket weave of 60 yarns as shown in FIG. 1 was inserted into a selvage of the raw fabric for an airbag in the weaving process.

Both sides of the fabric thus woven was subjected to silicone resin coating of 75 g/m$^2$ by a knife-over-air method. The coating weights of the left, middle, and right parts of the fabric for an airbag thus prepared were measured and are shown in the following Table 1.

Example 2

A polyester fabric for an airbag was prepared in the same manner as in Example 1, except that a 2×2 basket weave of 60 yarns as shown in FIG. 2 was inserted into the selvage of the raw fabric for an airbag in the weaving process.

Both sides of the fabric thus woven was subjected to silicone resin coating of 75 g/m$^2$ by a knife-over-air method. The coating weights of the left, middle, and right parts of the fabric for an airbag thus prepared were measured and are shown in the following Table 1.

Example 3

A polyester fabric for an airbag was prepared in the same manner as in Example 1, except that a 3×3 basket weave of 80 yarns as shown in FIG. 1 was inserted into the selvage of the raw fabric for an airbag in the weaving process.

Both sides of the fabric thus woven was subjected to silicone resin coating of 75 g/m$^2$ by a knife-over-air method. The coating weights of the left, middle, and right parts of the fabric for an airbag thus prepared were measured and are shown in the following Table 1.

Comparative Example 1

A polyester fabric for an airbag was prepared in the same manner as in Example 1, except that no additional basket weave was inserted into the selvage of the raw fabric for an airbag in the weaving process.

Both sides of the fabric thus woven were subjected to silicone resin coating of 75 g/m$^2$ by a knife-over-air method. The coating weights of the left, middle, and right parts of the fabric for an airbag thus prepared were measured and are shown in the following Table 1.

Comparative Example 2

A polyester fabric for an airbag was prepared in the same manner as in Example 2, except that the 2×2 basket weave of 120 yarns as shown in FIG. 2 was inserted into the selvage of the raw fabric for an airbag in the weaving process.

However, in the above-described weaving process, the tension of the selvage was excessively increased to thereby damage the weaving machine. Therefore, weaving of the fabric was impossible.

Comparative Example 3

A polyester fabric for an airbag was prepared in the same manner as in Example 1, except that the 3×3 basket weave of 18 yarns as shown in FIG. 1 was inserted into the selvage of the raw fabric for an airbag in the weaving process.

Both sides of the fabric thus woven was subjected to silicone resin coating of 75 g/m$^2$ by a knife-over-air method. The coating weights of the left, middle, and right parts of the fabric for an airbag thus prepared were measured and are shown in the following Table 1.

Conditions for preparing the polyester fabrics according to Examples 1 to 3 and Comparative Examples 1 to 3, and the results of measuring coating weights of the prepared fabrics, are as shown in the following Table 1.

TABLE 1

| | Fiber | Fabric | Weaving machine | Selvage weave | Coating weight (g/m$^2$) Left | Middle | Right |
|---|---|---|---|---|---|---|---|
| Example 1 | PET 500D/144f | 57 × 49 75 g/m$^2$ Coated OPW fabric | Jacquard Air jet | 3 × 3 basket 60 yarns | 80 | 74 | 78 |
| Example 2 | PET 500D/144f | 57 × 49 75 g/m$^2$ Coated OPW fabric | Jacquard Air jet | 2 × 2 basket 60 yarns | 79 | 72 | 76 |
| Example 3 | PET 500D/144f | 57 × 49 75 g/m$^2$ Coated OPW fabric | Jacquard Air jet | 3 × 3 basket 80 yarns | 81 | 77 | 80 |
| Comparative Example 1 | PET 500D/144f | 57 × 49 75 g/m$^2$ Coated OPW fabric | Jacquard Air jet | — | 98 | 76 | 100 |
| Comparative Example 2 | PET 500D/144f | 57 × 49 75 g/m$^2$ Coated OPW fabric | Jacquard Air jet | 2 × 2 basket 120 yarns | — (non-weavable) | — (non-weavable) | — (non-weavable) |
| Comparative Example 3 | PET 500D/144f | 57 × 49 75 g/m$^2$ Coated OPW fabric | Jacquard Air jet | 3 × 3 basket 18 yarns | 95 | 75 | 98 |

As shown in Table 1, it can be seen that since the fabrics of Examples 1 to 3 were prepared by inserting the optimized 3×3 basket weave or 2×2 basket weave into the selvage of the raw fabric for an airbag in the weaving process according to the present invention, tension of the finally-prepared whole fabric was controlled to be uniform and the coating agent was evenly applied onto the whole fabric upon processing and coating.

In contrast, when no additional basket weave was inserted into the selvage by the existing method in Comparative Example 1, a force applied to a weft insertion region was not the same as a force applied to a region opposite to the weft insertion region. Therefore, in Comparative Example 1, the force applied to a yarn in the weft insertion region became higher than a force applied to a yarn in the region opposite to the weft insertion region, and the fabric in the region opposite to the weft insertion region was not woven firmly, resulting in wrinkle generation in the selvage of the fabric. For this reason, the coating agent was not evenly applied onto the whole polyester fabric of Comparative Example 1 upon processing and coating. Further, it was confirmed that when the 3×3 basket weave of 18 yarns was inserted into the selvage in the weaving process in Comparative Example 3, wrinkles were generated in the selvage. Also, in Comparative Example 3, the coating agent was not evenly applied to the whole fabric upon coating. Meanwhile, it can be seen that when the 2×3 basket weave of 120 yarns was inserted into the selvage in the weaving process in Comparative Example 2, selvage tension was excessively increased to thereby damage the weaving machine, and the weaving of the fabric was impossible.

The invention claimed is:

1. A method of preparing a polyester fabric for an airbag, comprising weaving a raw fabric for an airbag using a polyester fiber to obtain a woven fabric, wherein the weaving comprises inserting a higher-density weave region in warp or weft direction into a selvage of the raw fabric for an airbag, wherein the higher-density weave region has a larger number of yarns and a higher tension than other part of the raw fabric, and is separately inserted into the selvage of the raw fabric, wherein the selvage is removed from the woven fabric by cutting in a cutting process to acquire an airbag cushion, wherein each of warpwise weaving density and weftwise weaving density of the polyester fabric is 36 to 65 yarns/inch, and wherein the higher-density weave region is a 2×2 basket weave, a 3×3 basket weave, or a mixed weave of one or more thereof, and comprises 20 yarns to 100 yarns.

2. The method according to claim 1, wherein the polyester fiber has a total fineness of 200 to 1000 denier.

3. The method according to claim 1, wherein the raw fabric for an airbag is weaved by an one piece woven method.

4. The method according to claim 1, further comprising coating the woven fabric with a rubber component.

5. The method according to claim 4, wherein the rubber component is one or more selected from the group consisting of a powder-type silicone, a liquid-type silicone, polyurethane, chloroprene, a neoprene rubber, polyvinyl chloride, and an emulsion-type silicone resin.

6. (The method according to claim 4, wherein a coating weight of the rubber component is 30 to 150 g/m$^2$.

7. The method according to claim 6, wherein a coating weight deviation of the rubber component per unit area of m$^2$ is within 20% in the width direction of the fabric.

8. The method according to claim 1, wherein the higher-density weave region is composed of 40 yarns to 90 yarns/inch.

9. The method according to claim 1, wherein the polyester fabric has a cover factor of 1780 or more according to the following Equation 1:

$$\text{Cover Factor (CF)} = \text{warp density} \times \sqrt{(\text{warpdenier})} + \text{weft density} \times \sqrt{(\text{weftdenier})} \quad \text{[Equation 1].}$$

* * * * *